US010464187B2

(12) United States Patent
Qian et al.

(10) Patent No.: US 10,464,187 B2
(45) Date of Patent: Nov. 5, 2019

(54) HIGH REMOVAL RATE CHEMICAL MECHANICAL POLISHING PADS FROM AMINE INITIATED POLYOL CONTAINING CURATIVES

(71) Applicant: Rohm and Haas Electronic Materials CMP Holdings, Inc., Newark, DE (US)

(72) Inventors: Bainian Qian, Newark, DE (US); Kancharla-Arun K. Reddy, Wilmington, DE (US); George C. Jacob, Newark, DE (US); Marty W. DeGroot, Middletown, DE (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 165 days.

(21) Appl. No.: 15/828,601

(22) Filed: Dec. 1, 2017

(65) Prior Publication Data

US 2019/0168356 A1 Jun. 6, 2019

(51) Int. Cl.
*B24B 37/24* (2012.01)
*B24B 37/22* (2012.01)
*B24B 37/04* (2012.01)

(52) U.S. Cl.
CPC ..... *B24B 37/24* (2013.01); *B24B 37/044* (2013.01); *B24B 37/22* (2013.01)

(58) Field of Classification Search
CPC ..... B24B 37/24; B24B 37/044; B24B 37/22
USPC ..... 451/527
See application file for complete search history.

(56) References Cited

U.S. PATENT DOCUMENTS 4,448,939 A * 5/1984 Fasolka ..... C08G 18/837 525/453
6,860,802 B1 3/2005 Vishwanathan et al.
7,169,030 B1 1/2007 Kulp
7,217,179 B2 * 5/2007 Sakurai ..... B24B 7/04 451/526
7,445,847 B2 11/2008 Kulp
8,052,507 B2 11/2011 Huang et al.
9,144,880 B2 9/2015 Qian et al.
9,259,821 B2 2/2016 Qian et al.
9,484,212 B1 11/2016 Qian et al.
2009/0062414 A1 3/2009 Huang et al.
2011/0039966 A1 * 2/2011 Goto ..... B24B 37/24 521/156
2015/0059254 A1 * 3/2015 Yeh ..... B24B 37/24 51/298
2015/0065013 A1 * 3/2015 Jensen ..... B24B 37/205 451/41
2015/0273651 A1 * 10/2015 Qian ..... B24B 37/013 216/38
2015/0306730 A1 * 10/2015 Qian ..... B24B 37/013 51/298
2015/0306731 A1 * 10/2015 Qian ..... H01L 21/30625 51/298
2017/0087688 A1 3/2017 Fu et al.
2017/0361421 A1 * 12/2017 Willumstad ..... B24B 37/24
2018/0071888 A1 * 3/2018 Weis ..... B24B 37/245

* cited by examiner

*Primary Examiner* — George B Nguyen
(74) *Attorney, Agent, or Firm* — Andrew Merriam

(57) ABSTRACT

A CMP polishing pad for polishing a semiconductor substrate is provided containing a polishing layer that comprises a polyurethane reaction product of a reaction mixture comprising a (i) curative of from 15 to 30 wt. % of an amine initiated polyol having an average of from 3 to less than 5 hydroxyl groups and a number average molecular weight of 150 to 400, and from 70 to 85 wt. % of an aromatic diamine and a (ii) polyisocyanate prepolymer having a number average molecular weight of from 600 to 5,000 and having an unreacted isocyanate content ranging from 6.5 to 11%. The CMP polishing pad has a tunable tan-delta peak temperature at from 50 to 80° C. which has a value of from 0.2 to 0.8 at the tan-delta peak temperature and is useful for polishing a variety of substrates.

10 Claims, No Drawings

HIGH REMOVAL RATE CHEMICAL MECHANICAL POLISHING PADS FROM AMINE INITIATED POLYOL CONTAINING CURATIVES

The present invention relates to chemical mechanical polishing pads and methods of making and using the same. More particularly, the present invention relates to a chemical mechanical polishing pad (CMP polishing pad) comprising a polishing layer or top polishing surface of a polyurethane reaction product of a reaction mixture comprising a curative of from 15 to 30 wt. % of an amine initiated polyol having an average of from 3 to less than 5, or, preferably, 4 hydroxyl groups and a number average molecular weight of 150 to 400 and from 70 to 85 wt. % of an aromatic diamine, and a polyisocyanate prepolymer having a molecular weight of from 600 to 5,000 and an amount of unreacted isocyanate content ranging from 6.5 to 11%.

In the production of any semiconductor, several chemical mechanical polishing (CMP) processes may be needed. In each CMP process, a polishing pad in combination with a polishing solution, such as an abrasive-containing polishing slurry or an abrasive-free reactive liquid, removes excess material in a manner that planarizes or maintains flatness of the semiconductor substrate. The stacking of multiple layers in semiconductors combines in a manner that forms an integrated circuit. The fabrication of such semiconductor devices continues to become more complex due to requirements for devices with higher operating speeds, lower leakage currents and reduced power consumption. In terms of device architecture, this translates to finer feature geometries and increased numbers of metallization levels or layers. Such increasingly stringent device design requirements drive the adoption of smaller line spacing with a corresponding increase in pattern density and device complexity; additionally, individual chip sizes are shrinking. Further, to save semiconductor manufacturers are turning to larger wafers containing more of the smaller chips. These trends have led to greater demands on CMP consumables such as polishing pads and polishing solutions and a need for improved chip yields as a result of CMP polishing.

There is an ongoing need for polishing pads that have increased removal rate in combination with improved layer uniformity. In particular, there is a desire for polishing pads suitable for multiple polishing applications, including front end of the line (FEOL), inter-layer dielectric (ILD) polishing and metals polishing.

U.S. Pat. No. 7,217,179 B2, to Sakurai et al. discloses polyurethane polishing pads which comprise CMP polishing pads having a polishing layer made of a polyurethane or polyurethane-urea made from reaction of a mixture of an isocyanate-terminated urethane prepolymer A and a chain extender B. Chain extender B has two or more active hydrogen groups of which from 50 to 100 wt. % has a number average molecular weight of 300 or less, and from 50 to 0 wt % has a number average molecular weight higher than 300; further, the chain extender B consists of from 20 to 100 wt. % of a chain extender having three or more active hydrogen-containing groups and 80 to 0 wt. % of a chain extender having two active hydrogen-containing groups in the molecule. The polishing layer is dampened on heating and exhibits a ratio of the storage elastic modulus at 30° C. to the storage elastic modulus at 60° C. of the polishing layer is 2 to 15; and the ratio of the storage elastic modulus at 30° C. to the storage elastic modulus at 90° C. of said polishing layer is 4 to 20. The CMP polishing pad of Sakurai suffers from incomplete hard and soft polymer matrix phase separation and an undesirable reduction in pad hardness. Further, the CMP polishing pad of Sakurai includes water soluble particles to avoid resulting in unacceptably high number of scratches from CMP polishing.

The present inventors have sought to solve the problem of providing an effective chemical mechanical polishing pad that provides good substrate uniformity and removal rate results over a number of different substrates.

STATEMENT OF THE INVENTION

1. In accordance with the present invention, a chemical mechanical polishing pad (CMP polishing pad) comprising a polishing layer or top polishing surface of a polyurethane reaction product of a reaction mixture comprising a (i) curative of from 15 to 30 wt. %, or, preferably, from 15 to 23 wt. %, or, more preferably, from 15 to less than 20 wt. % of an amine initiated polyol having an average of from 3 to less than 5, or, preferably, 4 hydroxyl groups and a number average molecular weight of 150 to 400, or, preferably, from 210 to 350, and from 70 to 85 wt. %, or, preferably, from 77 to 85 wt. %, or, more preferably, from more than 80 to 85 wt. % of an aromatic diamine and a (ii) polyisocyanate prepolymer having a number average molecular weight of from 600 to 5,000, or, preferably, from 800 to 3,000, and having an unreacted isocyanate content ranging from 6.5 to 11%, or, preferably, from 8 to 9.5 wt. %.

2. In accordance with the CMP polishing pad of the present invention as set forth in item 1, above, wherein the polishing layer has a tan-delta peak at from 50 to 80° C., further, as a ratio of torsional storage modulus (G') measured at 30° C. to torsional storage modulus (G') measured at 90° C. of from 5 to 45, and, preferably, still further has a tan-delta value of at the tan-delta peak temperature of from 0.2 to 0.8, or, preferably, from 0.3 to 0.7

3. In accordance with the CMP polishing pad of the present invention as set forth in any one of items 1 or 2, above, wherein the gel time of the reaction mixture ranges from 2 to 15 minutes, or, preferably, from 2 to 8 minutes, and in the (i) curative of the reaction mixture, the aromatic diamine is chosen from 4,4'-methylenebis(3-chloro-2,6-diethylaniline) (MCDEA); 4,4'-methylene-bis-o-chloroaniline (MbOCA); diethyl toluene diamines, such as 3,5-diethytoluene-2,4-diamine, 3,5-diethytoluene-2,6-diamine or their mixtures; tert-butyl toluene diamines, such as 5-tert-butyl-2,4- or 3-tert-butyl-2,6-toluenediamine; chlorotoluenediamines; dimethylthio-toluene diamines (DMTDA); 1,2-bis(2-aminophenylthio)ethane; trimethylene glycol di-p-amino-benzoate; tert-amyl toluenediamines, such as 5-tert-amyl-2,4- and 3-tert-amyl-2,6-toluenediamine; tetramethyleneoxide di-p-aminobenzoate; (poly)propyleneoxide di-p-aminobenzoates; chloro diaminobenzoates; methylene dianilines, such as 4,4'-methylene-bis-aniline; isophorone diamine; 1,2-diaminocyclohexane; bis(4-aminocyclohexyl)methane; 4,4'-diaminodiphenyl sulfone; m-phenylenediamine; xylene diamines; 1,3-bis(aminomethyl cyclohexane); and mixtures thereof, preferably, 4,4'-methylene-bis-o-chloroaniline, and.

4. In accordance with the CMP polishing pad of present invention as in any one of items 1, 2, or 3, above, wherein in the (i) curative of the reaction mixture, the amine initiated polyol is an ethylene diamine or aminoethylethanolamine (AEEA) initiated polyol, such as the reaction product of either of these with an alkylene oxide.

5. In accordance with the CMP polishing pad of present invention as in any one of items 1, 2, 3, or 4, above, wherein the (ii) polyisocyanate prepolymer of the reaction mixture is formed from an aromatic diisocyanate, such as an aromatic diisocyanate chosen from a toluene diisocyanate (TDI); methylene diphenyl diisocyanate (MDI); napthalene diisocyanate (NDI); paraphenylene diisocyanate (PPDI); or o-toluidine diisocyanate (TODD; a modified diphenylmethane diisocyanate, such as a carbodiimide-modified diphenylmethane diisocyanate; an allophanate-modified diphenylmethane diisocyanate; a biuret-modified diphenylmethane diisocyanate; an aromatic isocyanurate from a diisocyanate, such as the isocyanurate of MDI; aromatic diisocyanates mixed with up to 50 wt. %, or preferably, 25 wt. % or less of an alicyclic diisocyanate, such as, 4,4'-methylenebis(cyclohexyl isocyanate) ($H_{12}$-MDI), based on the total weight of the aromatic and any alicyclic diisocyanates; or a mixture of aromatic diisocyanates, such as a mixture of TDI and up to 20 wt. % of MDI, based on the total weight of the aromatic diisocyanates thereof; and from a polyol chosen from polypropylene glycol (PPG), polytetramethylene ether glycol (PTMEG), polyethylene glycol, or, a mixture thereof.

6. In accordance with the CMP polishing pad of present invention as in any one of items 1, 2, 3, 4, or 5, above, wherein the reaction mixture of the present invention is "substantially water free", based on the total weight of the reaction mixture.

7. In accordance with the CMP polishing pad of present invention as in any one of items 1, 2, 3, 4, 5, or 6, above, wherein the polishing layer in the CMP polishing pad has a density of from 0.4 to 1.2 g/cm$^3$, or, preferably, from 0.6 to 1.0 g/cm$^3$.

8. In accordance with the CMP polishing pad of present invention as in any one of items 1, 2, 3, 4, 5, 6, or 7, above, wherein in the reaction mixture the stoichiometric ratio of the sum of the total moles of amine ($NH_2$) groups and the total moles of hydroxyl (OH) groups) in the (i) curative to the total moles of unreacted isocyanate (NCO) groups in the (ii) polyisocyanate prepolymer ranges from 0.75:1 to 1.25:1, or, preferably, from 0.85:1 to 1.15:1.

9. In accordance with the CMP polishing pad of present invention as in any one of items 1, 2, 3, 4, 5, 6, 7, or 8, above, wherein the polishing layer of the CMP polishing pad has a Shore D hardness according to ASTM D2240-15 (2015) of from 30 to 80, or preferably, from 40 to 70.

10. In accordance with the CMP polishing pad of present invention as in any one of items 1, 2, 3, 4, 5, 6, 7, 8 or 9, above, wherein the polishing pad or polishing layer contains no microelements and the reaction mixture further comprises a surfactant, such as a siloxy-group containing nonionic polyether polyol, an alkoxy ether thereof, a polysiloxane-polyetherpolyol block copolymer, or an alkoxy ether thereof.

11. In accordance with the chemical mechanical polishing pad of the present invention as in any one of items 1, 6, 7, 8, 9, or 10, above, wherein the polishing layer of the polishing pad further comprises microelements chosen from entrapped gas bubbles, hollow core polymeric materials, such as polymeric microspheres, liquid filled hollow core polymeric materials, such as fluid-filled polymeric microspheres, and fillers, such as boron nitride, preferably, expanded fluid-filled polymeric microspheres.

12. In another aspect, the present invention provides methods of making chemical mechanical (CMP) polishing pads having a polishing layer adapted for polishing a substrate comprising providing a female mold in the outer diameter of a CMP polishing layer; providing one or more isocyanate component of (ii) a polyisocyanate prepolymer as set forth in the reaction mixture of any one of items 1 or 5, above, at a temperature of from ambient to 65° C., or, preferably, from 45 to 65° C. and forming a mixture containing from 0.0 to 5.0 wt. % or, preferably, 0.4 to 4 wt. %, based on the total weight of the isocyanate component, of one or more microelements, wherein the microelements, if included, and the polyisocyanate prepolymer are blended together; providing, as a separate component, a (ii) curative of from 15 to 30 wt. %, or, preferably, from 15 to 23 wt. %, or, more preferably, from 15 to less than 20 wt. % of an amine initiated polyol having an average of from 3 to less than 5, or, preferably, 4 hydroxyl groups and a number average molecular weight of 150 to 400 and from 70 to 85 wt. %, or, preferably, from 77 to 85 wt. %, or, more preferably, from more than 80 to 85 wt. % of an aromatic diamine; preferably, preheating a mold to from 60 to 100° C., or, preferably, from 65 to 95° C.; filling the mold with the reaction mixture, and heat curing the reaction mixture at a temperature of from 80 to 120° C. for a period of from 4 to 24 hours, or, preferably, from 6 to 16 hours to form a cast polyurethane; and forming a polishing layer from the cast polyurethane.

13. In accordance with the methods of making a chemical mechanical polishing pad of present invention as in item 12, above, wherein the reaction mixture is organic solvent free and substantially water-free, or, preferably, water free.

14. In accordance with the methods of making a chemical mechanical polishing pad of present invention as in any one of items 12 or 13, above, wherein the forming a polishing layer comprises skiving or slicing the cast polyurethane to form a plurality of polishing layers having a desired thickness.

15. In accordance with the methods of making a chemical mechanical polishing pad of present invention as in any one of items 12, 13, or 14, above, wherein the forming a polishing layer comprises machining, grinding or routing the top surface of the cast polyurethane or polishing layers to form grooves therein.

16. In accordance with the methods of making a chemical mechanical polishing pad of present invention as in any one of items 12, 13, 14, or 15, above, wherein the forming a polishing layer further comprises post-curing the polishing layer at a temperature of from 85 to 165° C., or, from 95 to 125° C., for a period of time, such as from 2 to 30 hours, or, preferably, from 4 to 20 hours.

17. In accordance with the methods of making a CMP polishing pad of the present invention as in any one of items 12 to 16, above, wherein the forming of the polishing pad further comprises stacking a sub pad layer, such as a polymer impregnated non-woven, or polymer sheet, onto bottom side of a polishing layer so that the polishing layer forms the top of the polishing pad.

In accordance with the methods of making a CMP polishing pad in accordance with the present invention, the (i) curative, including the aromatic diamine and the amine initiated polyol, and the (ii) polyisocyanate prepolymer, including the aromatic diisocyanate and the polyol, can be chosen, respectively, from any of the (i) curative of the first aspect of the present invention and the (ii) polyisocyanate prepolymer of the first aspect of the present invention or any of the materials used to make either of these.

18. In yet another aspect, the present invention provides methods of polishing a substrate, comprising: Providing a substrate selected from at least one of a magnetic substrate, an optical substrate and a semiconductor substrate; providing a chemical mechanical (CMP) polishing pad according to any one of items 1 to 11, above; creating dynamic contact between a polishing surface of the polishing layer of the CMP polishing pad and the substrate to polish a surface of the substrate; and, conditioning of the polishing surface of the polishing pad with an abrasive conditioner.

Unless otherwise indicated, conditions of temperature and pressure are ambient temperature and standard pressure. All ranges recited are inclusive and combinable.

Unless otherwise indicated, any term containing parentheses refers, alternatively, to the whole term as if no parentheses were present and the term without them, and combinations of each alternative. Thus, the term "(poly) isocyanate" refers to isocyanate, polyisocyanate, or mixtures thereof.

As used herein, unless specifically noted otherwise the formulations are expressed in wt. % solids.

All ranges are inclusive and combinable. For example, the term "a range of 50 to 3000 cPs, or 100 or more cPs" would include each of 50 to 100 cPs, 50 to 3000 cPs and 100 to 3000 cPs.

As used herein, the term "amine initiated polyol" refers to a polyol having a tertiary amine group, initiated from an amine such as ethylene diamine or aminoethylethanolamine (AEEA), such as by reaction thereof with an alkylene oxide like ethylene oxide or propylene oxide.

As used herein, the term "ASTM" refers to publications of ASTM International, West Conshohocken, Pa.

As used herein, the terms E' or "tensile storage modulus", E" or "tensile loss modulus", and E"/E' (which corresponds to "tan delta" or "Tan D") refer to the results of a test wherein polishing layer or pad specimens were cut with 6 mm width and 36 mm length and subject to a dynamic mechanical analysis (DMA). A Rheometric Scientific™ TMRSA3 strain controlled rheometer (TA Instruments, New Castle, Del.) was used in accordance with the method published as ASTM D5026-15 (2015), "Standard Plastics: Dynamic Mechanical Properties: In Tension." The gap separation was 30 mm and each sample was rectangular and had a width of ~6.0 mm. Instrument analysis parameters were set to at 50 g of preload, frequency of 1 Hz, an amplitude of 30 μm and a temperature ramp setting of 5° C./min from 0 to 120° C.

As used herein, the terms G' or "torsional storage modulus", G" or "torsional loss modulus", and G"/G' (which corresponds to "tan delta" or "Tan D") refer to the results of a test wherein polishing layer or pad specimens were cut with 6 mm width and 36 mm length and subject to a dynamic mechanical analysis (DMA). An ARES™ G2 torsional rheometer or a Rheometric Scientific™ RDA3 (TA Instruments) were used in accordance with the method published as ASTM D5279-13 (2013), "Standard Test Method for Plastics: Dynamic Mechanical Properties: In Torsion." The gap separation was 20 mm. Instrument analysis parameters were set at 100 g of preload, 0.2% strain, oscillation speed of 10 rads/sec, and temperature ramp rate was set at 3° C./min from −100° C. to 150° C.

As used herein, the term "gel time" means the result obtained by mixing a given reaction mixture at about 50° C., for example, in an VM-2500 vortex lab mixer (StateMix Ltd., Winnipeg, Canada) set at 1000 rpm for 30 s, setting a timer to zero and switching the timer on, pouring the mixture into an aluminum cup, placing the cup into a hot pot of a gel timer (Gardco Hot Pot™ gel timer, Paul N. Gardner Company, Inc., Pompano Beach, Fla.) set at 65° C., stirring the reaction mixture with a wire stirrer at 20 RPM and recording the gel time when the wire stirrer stops moving in the sample.

As used herein, unless otherwise indicated, the term "number average molecular weight" or "Mn" and "weight average molecular weight" or "Mw" means that value determined by gel permeation chromatography (GPC) at room temperature using an Agilent 1100 High Pressure Liquid Chromatogram (HPLC) (Agilent, Santa Clara, Calif.) equipped with an isocratic pump, an autosampler (Injection volume (50 μl) and a Series of 4 PL-Gel™ (7 mm×30 cm×5 μm) columns, each filled with a polystyrene divinyl benzene (PS/DVB) gel in a succession of pore sizes of 50, 100, 500 and then 1000 Å against a standard calibrated from a polyol mixture (1.5 wt. % in THF) of polyethylene glycols and polypropylene glycols as standards. For polyisocyanate prepolymers, the isocyanate functional (N═C═O) groups of the isocyanate samples were converted with methanol from a dried methanol/THF solution to non-reactive methyl carbamates.

As used herein, the term "polyisocyanate" means any isocyanate group containing molecule having three or more isocyanate groups, including blocked isocyanate groups.

As used herein, the term "polyisocyanate prepolymer" means any isocyanate group containing molecule that is the reaction product of an excess of a diisocyanate or polyisocyanate with an active hydrogen containing compound containing two or more active hydrogen groups, such as diamines, diols, triols, and polyols.

As used herein, the term "polyurethanes" refers to polymerization products from difunctional or polyfunctional isocyanates, e.g. polyetherureas, polyisocyanurates, polyurethanes, polyureas, polyurethaneureas, copolymers thereof and mixtures thereof.

As used herein, the term "reaction mixture" includes any non-reactive additives, such as microelements or additives to boost modulus or flexural rigidity, such as boron nitride or a polymeric polyacid, such as poly(methacrylic acid) or salts thereof.

As used herein, the term "removal rate" refers to the removal rate as expressed in Å/min.

As used herein, the term "Shore D hardness" is the hardness of a given material as measured according to ASTM D2240-15 (2015), "Standard Test Method for Rubber Property-Durometer Hardness". Hardness was measured on a Rex Hybrid hardness tester (Rex Gauge Company, Inc., Buffalo Grove, Ill.), equipped with a D probe. Six samples were stacked and shuffled for each hardness measurement; and each pad tested was conditioned by placing it in 50 percent relative humidity for five days at 23° C. before testing and using methodology outlined in ASTM D2240-15 (2015) to improve the repeatability of the hardness tests. In the present invention, the Shore D hardness of the polyurethane reaction product of the polishing layer or pad includes the Shore D hardness of that reaction including any additive to lower Shore D hardness.

As used herein, the term "stoichiometry" of a reaction mixture refers to the ratio of molar equivalents of (unreacted OH+unreacted $NH_2$ groups) in the (i) curative component of the reaction mixture to unreacted NCO groups in the (ii) polyisocyanate prepolymer component of the reaction mixture As used herein, the term "SG" or "specific gravity" refers to the weight/volume ratio of a rectangular cut out of a polishing pad or layer in accordance with the present invention.

As used herein, the term "solids" refers to any materials that remain in the polyurethane reaction product of the present invention; thus, solids include reactive and non-volatile additives that do not volatilize upon cure. Solids exclude water, ammonia and volatile solvents.

As used herein, unless otherwise indicated, the term "substantially water free" means that a given composition has no added water and that the materials going into the composition have no added water. A reaction mixture that is "substantially water free" can comprise water that is present in the raw materials, in the range of from 50 to 2000 ppm or, preferably, from 50 to 1000 ppm, or can comprise reaction water formed in a condensation reaction or vapor from ambient moisture where the reaction mixture is in use.

As used herein, the term "use conditions" means the temperature and pressure at which one conducts CMP polishing of a substrate, or at which the polishing occurs at the surface of the CMP polishing pad.

As used herein, unless otherwise indicated, the term "viscosity" refers to the viscosity of a given material in neat form (100%) at a given temperature as measured using a rheometer, set at an oscillatory shear rate sweep from 0.1-100 rad/sec in a 50 mm parallel plate geometry with a 100 μm gap.

As used herein, unless otherwise indicated, the term "wt. % NCO" refers to the amount of unreacted or free isocyanate groups in a given polyisocyanate prepolymer composition.

As used herein, the term "wt. %" stands for weight percent.

In accordance with the present invention, a chemical mechanical (CMP) polishing pad has a top polishing surface comprising the reaction product of a reaction mixture of a (i) curative of from 15 to 30 wt. % of an amine initiated polyol having an average of from 3 to less than 5, or, preferably, 4 hydroxyl groups and a number average molecular weight of 150 to 400 and from 70 to 85 wt. % of a polyamine, preferably, an aromatic diamine, and (ii) a polyisocyanate prepolymer having a number average molecular weight of from 600 to 5,000 and having an unreacted isocyanate content ranging from 6.5 to 11%. The CMP polishing layer has a tan-delta peak (measured as G"/G' by shear dynamic mechanical analysis (DMA), ASTM D5279-13 (2013)) at between 50 and 80° C. and a ratio of torsional storage modulus measured at 30° C. to that measured 90° C. in the range of from 5:1 to 45:1, whereby the pad provides lower non-uniformity from polishing a variety of substrates without a corresponding decrease in removal rate.

The CMP polishing layer in accordance with the present invention maintains a high damping component at polishing use temperature regime. The ratio of storage modulus at a lower temperature to storage modulus measured at a given higher temperature can be termed a "damping component." A suitable high damping component enables increased pad area contact with a given substrate, without being so high that the pad becomes excessively soft in use to remove material from the substrate. Conventional CMP polishing pads used in chemical mechanical planarization (CMP) processes have tan-delta values of less than 0.2 around polishing temperatures. Accordingly, the CMP polishing pads of the invention are efficacious for polishing softer substrates, such as tungsten and copper; and yet the CMP polishing pads find use for dielectric oxide or interlayer dielectric (ILD) polishing. Further, the CMP polishing layer in accordance with the present invention exhibits a high tan-delta peak at a temperature of 50° C. or higher, or, preferably, 55° C. or higher. Tan-delta is defined as the ratio of tensile loss modulus (E") over tensile storage modulus (E') or the ratio of torsional loss modulus (G") over torsional storage modulus (G'). Further, at the tan-delta peak temperature, the tan-delta value of the CMP polishing pad of the present invention ranges from 0.2 to 0.8, or, preferably, 0.3 to 0.7. The high tan-delta peak temperature of 50° C. or higher is essential to achieve global planarization efficiency and polishing uniformity. With a higher tan-delta value at the high peak temperature, more energy during dynamic deformation of polishing will be dissipated into heat than energy stored, thereby enabling the polishing of harder substrates at higher downforces without increasing scratch defects on the substrates. In particular, the CMP polishing pads of the present invention have demonstrated improved removal rates in multiple polishing applications, i.e. on different substrates. Further, the CMP polishing pads of the present invention enable decreased non-uniformity in multiple substrates during polishing while maintaining a high substrate removal rate polishing performance.

The chemical mechanical polishing pads of the present invention comprise a polishing layer which is a homogenous dispersion of microelements in a porous polyurethane or a homogeneous polyurethane.

The polyurethane polymeric material or reaction product is preferably formed from, on the one hand, a polyisocyanate prepolymer reaction product of, preferably, an aromatic diisocyanate, such as toluene diisocyanate, with a polyol, such as a polytetramethylene ether glycol (PTMEG) with polypropylene glycol (PPG) and polyethylene glycol (PEG) or with PPG having ethylene oxide repeat units, which are hydrophilic groups and, on the other hand, (i) a curative of from 15 to 30 wt. % of an amine initiated polyol having an average of from 3 to less than 5, or, preferably, 4 hydroxyl groups and a number average molecular weight of 150 to 400 and from 70 to 85 wt. % of a polyamine, preferably, an aromatic diamine.

Typically, the reaction mixture contains the (i) curative which comprises in part one or more aromatic diamine or mixture thereof with an aliphatic diamine, such as hexamethylamine diamine or cyclohexylene diamine. Examples of suitable aromatic diamines include 4,4'-methylene-bis-o-chloroaniline (MbOCA); dimethylthiotoluenediamine; trimethyleneglycol di-p-aminobenzoate; polytetramethyleneoxide di-p-aminobenzoate; polytetramethyleneoxide mono-p-aminobenzoate; polypropyleneoxide di-p-aminobenzoate; polypropyleneoxide mono-p-aminobenzoate; 1,2-bis(2-aminophenylthio)ethane; 4,4'-methylene-bis-aniline; dialkyl-toluene diamines, such as diethyltoluenediamine; 5-tert-butyl-2,4- and 3-tert-butyl-2,6-toluenediamine; 5-tert-amyl-2,4- and 3-tert-amyl-2,6-toluenediamine and chlorotoluenediamine, preferably, 4,4'-methylene-bis-o-chloroaniline. A diamine curative of the present invention can be a mixture of 3,5-diethyltoluene-2,4-diamine and 3,5-diethyltoluene-2,6-diamine.

The reaction mixtures in accordance with the present invention further comprise ii) a polyisocyanate prepolymer having a molecular weight of from 600 to 5,000 and having an unreacted isocyanate content ranging from 6.5 to 11 wt. %.

The isocyanate-terminated prepolymer has a number average molecular weight of 600 to 5000; the molecular weight of such a prepolymer, which is formed from a mixture of a diol and diisocyanates in a molar ratio of about 1:2, is inversely proportional to its free isocyanate content (% NCO) insures that the polyisocyanate prepolymer has the correct % NCO.

The (ii) polyisocyanate prepolymer of the reaction mixture in accordance with the present invention is formed as a prepolymer reaction product of a diisocyanate, such as an aromatic diisocyanate, for example, toluene diisocyanate, with a polymeric diol, such as a polytetramethylene ether glycol (PTMEG), a polypropylene glycol (PPG), a polyethylene glycol (PEG), a PPG having ethylene oxide repeat units, or a polyol blend of polytetramethylene ether glycol and polypropylene glycol blend.

Suitable aromatic diisocyanates useful for making the polyisocyanate prepolymer in accordance with the present invention include any one chosen from methylene diphenyl diisocyanate (MDI); toluene diisocyanate (TDI); napthalene diisocyanate (NDI); paraphenylene diisocyanate (PPDI); or o-toluidine diisocyanate (TODD; a modified diphenylmethane diisocyanate, such as a carbodiimide-modified diphenylmethane diisocyanate, an allophanate-modified diphenylmethane diisocyanate, a biuret-modified diphenylmethane diisocyanate; an aromatic isocyanurate from a diisocyanate, such as the isocyanurate of MDI; aromatic diisocyanates mixed with up to 50 wt. %, or preferably, 25 wt. % or less of an alicyclic diisocyanate, such as, 4,4'-methylenebis (cyclohexyl isocyanate) ($H_{12}$-MDI) based on the total weight of the aromatic and any alicyclic diisocyanates; or a mixture of TDI and up to 20 wt. % of MDI, based on the total weight of the aromatic diisocyanates. Preferably, the aromatic diisocyanate comprises toluene diisocyanate (TDI), a mixture of TDI and up to 20 wt. % of MDI, based on the total weight of the aromatic diisocyanates.

The aromatic diisocyanate or aromatic and alicyclic diisocyanate is partially reacted with the polyol blend to form a polyisocyanate prepolymer prior to producing the final polymer matrix.

The polyisocyanate prepolymer can further be combined with methylene diphenyl diisocyanate (MDI), or diol or polyether extended MDI or it can further be the reaction product of the aromatic diisocyanate, polyol and MDI or extended MDI, wherein MDI is present in the amount of from 0.05 to 20 wt. %, or, for example, up to 15 wt. % or, for example, from 0.1 to 12 wt. %, based on the total weight of the aromatic diisocyanates used to make the polyisocyanate prepolymer.

The polyisocyanate prepolymer can further be combined with methylene bis-cyclohexyl diisocyanate ($H_{12}$-MDI), or diol or polyether extended $H_{12}$-MDI, or it can further be the product of the aromatic diisocyanate, polyol and $H_{12}$-MDI or extended $H_{12}$-MDI, wherein $H_{12}$-MDI is present in the amount of from 0 to 60 wt. %, or, for example, up to 50 wt. % or, for example, from 0 to 25 wt. %, based on the total weight of the aromatic and alicyclic diisocyanate used to make the polyisocyanate prepolymer. This combination can also be combined or reacted with from 0 to 20 wt. %, or, for example, up to 15 wt. % or, for example, from 0 to 12 wt. % of MDI, based on the total weight of the aromatic diisocyanates used to make the polyisocyanate prepolymer.

For clarity, the weight of MDI or $H_{12}$-MDI in the case of a diol or polyether extended MDI or $H_{12}$-MDI is considered to be the weight fraction of MDI or $H_{12}$-MDI itself in the extended MDI or $H_{12}$-MDI.

Preferably, the diisocyanate component of the (ii) polyisocyanate prepolymer in accordance with the present invention contains less than 50 wt. % aliphatic isocyanates and more preferably, less than 25 wt. % aliphatic isocyanate. Most preferably, the mixture contains only impurity levels of aliphatic isocyanate.

To increase the reactivity of a polyol with a diisocyanate or polyisocyanate to make a polyisocyanate prepolymer, a catalyst may be used. Suitable catalysts include, for example, oleic acid, azelaic acid, dibutyltindilaurate, 1,8-diazabicyclo[5.4.0]undec-7-ene (DBU), tertiary amine catalysts, such as Dabco TMR, and mixture of the above.

Suitable polyols for use in making the polyisocyanate prepolymer of the present invention may include PTMEG, PPG, or their mixtures, and may also include polyester polyols and other polyether polyols, such as polyethylene-co-propylene glycols having a molecular weight that will provide an isocyanate terminated polyisocyanate prepolymer having the number average molecular weight of the present invention.

Available examples of PTMEG containing polyols are as follows: Terathane™ 2900, 2000, 1800, 1400, 1000, 650 and 250 from Invista, Wichita, Kans.; Polymeg™ 2900, 2000, 1000, 650 from Lyondell Chemicals, Limerick, Pa.; Poly-THF™ 650, 1000, 2000 from BASF Corporation, Florham Park, N.J. Available examples of PPG containing polyols are as follows: Arcol™ PPG-425, 725, 1000, 1025, 2000, 2025, 3025 and 4000 from Covestro, Pittsburgh, Pa.; Voranol™ 1010L, 2000L, and P400 from Dow, Midland, Mich.; Desmophen™ 1110BD or Acclaim™ Polyol 12200, 8200, 6300, 4200, 2200, each from Covestro.

Examples of suitable commercially available PTMEG containing isocyanate terminated urethane prepolymers include Imuthane™ prepolymers (available from COIM USA, Inc., West Deptford, N.J.) such as, PET-80A, PET-85A, PET-90A, PET-93A, PET-95A, PET-60D, PET-70D, or PET-75D; Adiprene™ prepolymers (Chemtura, Philadelphia, Pa.), such as, for example, LF 800A, LF 900A, LF 910A, LF 930A, LF 931A, LF 939A, LF 950A, LF 952A, LF 600D, LF 601D, LF 650D, LF 667, LF 700D, LF750D, LF751D, LF752D, LF753D or L325); Andur™ prepolymers (Anderson Development Company, Adrian, Mich.), such as, 70APLF, 80APLF, 85APLF, 90APLF, 95APLF, 60DPLF, 70APLF, or 75APLF.

Examples of commercially available PPG-containing isocyanate-terminated urethane prepolymers include Adiprene™ prepolymers (Chemtura), such as LFG 963A, LFG 964A, LFG 740D; Andur™ prepolymers (Anderson Development Company, Adrian, Mich.), such as, 7000 AP, 8000 AP, 6500 DP, 9500 APLF, 7501, or DPLF. A particular example of a suitable PTMEG-containing prepolymer capable of producing polymers within this TDI range is Adiprene™ prepolymer LF750D manufactured by Chemtura. Examples of suitable PPG-based prepolymers include Adiprene™ prepolymer LFG740D and LFG963A.

The polyisocyanate prepolymer used in the formation of the polishing layer of the chemical mechanical polishing pad of the present invention has an unreacted or free isocyanate (NCO) content ranging from 6.5 to 11%, or, preferably, from 8 to 9.5 wt. %.

Preferably, the polyisocyanate prepolymers of the present invention are low-free isocyanate prepolymers that have less than 0.1 wt. % each of free aromatic diisocyanate and alicyclic diisocyanate monomers and has a more consistent prepolymer molecular weight distribution than conventional prepolymers. "Low free" prepolymers with improved prepolymer molecular weight consistency and low free isocyanate monomer content facilitate a more regular polymer structure, and contribute to improved polishing pad consistency.

To insure that the resulting pad morphology is stable and easily reproducible, for example, it is often important to control additives such as anti-oxidizing agents, and impurities such as water for consistent manufacturing. For example, because water reacts with isocyanate to form gaseous carbon dioxide, the water concentration can affect the concentration of carbon dioxide bubbles that form pores in the polymeric matrix. Isocyanate reaction with adventitious water also reduces the available isocyanate for reacting with the polyamine, so it changes the molar ratio of OH or $NH_2$ to NCO groups along with the level of crosslinking (if there is an excess of isocyanate groups) and resulting polymer molecular weight.

In the reaction mixture of the present invention, the stoichiometric ratio of the sum of the total amine ($NH_2$) groups and the total hydroxyl (OH) groups in the reaction mixture to the sum of the unreacted isocyanate (NCO) groups in the reaction mixture ranges from 0.75:1 to 1.25:1, or, preferably, from 0.85:1 to 1.15:1.

The reaction mixture of the present invention is free of added organic solvents.

Homogeneity is important in achieving consistent polishing pad performance, especially where a single casting is used to make multiple polishing pads. Accordingly, the reaction mixture of the present invention is chosen so that the resulting pad morphology is stable and easily reproducible. For example, it is often important to control additives such as anti-oxidizing agents, and impurities such as water for consistent manufacturing. Because water reacts with isocyanate to form gaseous carbon dioxide and a weak reaction product relative to urethanes generally, the water concentration can affect the concentration of carbon dioxide bubbles that form pores in the polymeric matrix as well as the overall consistency of the polyurethane reaction product. Isocyanate reaction with adventitious water also reduces the available isocyanate for reacting with chain extender, so changing the stoichiometry along with level of crosslinking (if there is an excess of isocyanate groups) and tends to lower resulting polymer molecular weight.

To insure homogeneity and good molding results and fill the mold completely, the reaction mixture of the present invention should be well dispersed and have a gel time under reaction temperature and pressure conditions of 15 minutes or less, or, preferably, 10 minutes or less. Such a gel time allows the reaction mixture to flow into a mold without being so long as to cause microelements such as hollow core polymeric microspheres or pores to rise up or segregation in a polishing pad. On the other hand, if the gel time is too short, it can become difficult to completely fill the mold before the material gels or in extreme cases, polishing pads can become warped or cracked. Generally, the reaction mixture of the present invention has a gel time of from 2 to 15 minutes or, preferably, from 2 to 8 minutes.

In accordance with the methods of making the polishing layer of the present invention, the methods may comprise providing the polyisocyanate prepolymer of the present invention at a temperature of from its melting point to 65° C., such as from 45 to 65° C., forming the reaction mixture of the polyisocyanate prepolymer, the curative and, if desired, a microelement material as one component and the curative as another component, preheating a mold to from 40 to 100° C., or, preferably, from 60 to 100° C., or, more preferably, from 65 to 95° C., filling the mold with the reaction mixture and heat curing the reaction mixture at a temperature of from 80 to 120° C. for a period of from 4 to 24 hours, or, preferably, from 6 to 16 hours to form a molded polyurethane reaction product.

The methods of forming the polishing layer of the present invention comprising skiving or slicing the molded polyurethane reaction product to form a layer having a thickness of from 0.5 to 10 mm, or, preferably, from 1 to 3 mm.

The chemical mechanical polishing pads of the present invention can comprise just a polishing layer of the polyurethane reaction product or the polishing layer stacked on a subpad or sub layer. The polishing pad or, in the case of stacked pads, the polishing layer of the polishing pad of the present invention is useful in both porous and non-porous or unfilled configurations. Regardless of whether it is porous or non-porous, the finished polishing pad or polishing layer (in a stacked pad) has a density of 0.4 to 1.2 g/cm$^3$ or, preferably, from 0.6 to 1.0 g/cm$^3$. It is possible to add porosity through gas dissolution, blowing agents, mechanical frothing and introduction of hollow microspheres. Polishing pad density is as measured according to ASTM D1622-08 (2008). Density correlates closely, within 1-2% of specific gravity.

The porosity in the polishing layer of the present invention typically has an average diameter of 2 to 50 μm. Most preferably, the porosity arises from hollow polymeric particles having a spherical shape. Preferably, the hollow polymeric particles have a weight average diameter of 2 to 40 μm. For purposes of the specification, weight average diameter represents the diameter of the hollow polymeric particle before casting; and the particles may have a spherical or non-spherical shape. Most preferably, the hollow polymeric particles have a weight average diameter of 10 to 40 μm.

The polishing layer of the chemical mechanical polishing pad of the present invention optionally further comprises microelements which, preferably, are uniformly dispersed throughout the polishing layer. Such microelements, especially hollow spheres, may expand during casting. The microelements may be selected from entrapped gas bubbles, hollow core polymeric materials, such as polymeric microspheres, liquid filled hollow core polymeric materials, such as fluid filled polymeric microspheres, water soluble materials, an insoluble phase material (e.g., mineral oil), and abrasive fillers, such as boron nitride. Preferably, the microelements are selected from entrapped gas bubbles and hollow core polymeric materials uniformly distributed throughout the polishing layer. The microelements have a weight average diameter of less than 100 μm (preferably, from 5 to 50 μm). More preferably, the plurality of microelements comprise polymeric microspheres with shell walls of either polyacrylonitrile or a polyacrylonitrile copolymer (e.g., Expancel™ beads from Akzo Nobel, Amsterdam, Netherlands).

In accordance with the present invention, the microelements are incorporated into the polishing layer at from 0 to 5 wt. %, based on the total solids weight of the reaction mixture and the microelements, or, preferably, 0.4 to 4.0 wt. %. Such amounts of microelements represent roughly up to 66 vol. %, preferably, from 6 to 66 vol. % porosity or, preferably, from 10 to 50 vol. %.

The polishing layer of the chemical mechanical polishing pad of the present invention exhibits a Shore D hardness of 30 to 80 as measured according to ASTM D2240-15 (2015), or, preferably, from 40 to 70 for the polishing layer or pad containing microelements.

Preferably, the polishing layer of the chemical mechanical polishing pad of the present invention exhibits an elongation to break of from 50 to 450% or, preferably, from 125 to 425% (still more preferably 150 to 350%; most preferably 250 to 350%) as measured according to ASTM D412-06a (2006).

Preferably, the polishing layer used in the chemical mechanical polishing pad of the present invention has an average thickness of from 500 to 3750 microns (20 to 150 mils), or, more preferably, from 750 to 3150 microns (30 to 125 mils), or, still more preferably, from 1000 to 3000 microns (40 to 120 mils), or, most preferably, from 1250 to 2500 microns (50 to 100 mils).

The chemical mechanical polishing pad of the present invention optionally further comprises at least one additional layer interfaced with the polishing layer. Preferably, the chemical mechanical polishing pad optionally further comprises a compressible sub pad or base layer adhered to the polishing layer. The compressible base layer preferably improves conformance of the polishing layer to the surface of the substrate being polished.

The polishing layer of the chemical mechanical polishing pad of the present invention has a polishing surface adapted for polishing the substrate. Preferably, the polishing surface has macrotexture selected from at least one of perforations and grooves. Perforations can extend from the polishing surface part way or all the way through the thickness of the polishing layer.

Preferably, grooves are arranged on the polishing surface such that upon rotation of the chemical mechanical polishing pad during polishing, at least one groove sweeps over the surface of the substrate being polished.

Preferably, the polishing surface has macrotexture including at least one groove selected from the group consisting of curved grooves, linear grooves, perforations and combinations thereof.

Preferably, the polishing layer of the chemical mechanical polishing pad of the present invention has a polishing surface adapted for polishing the substrate, wherein the polishing surface has a macrotexture comprising a groove pattern formed therein. Preferably, the groove pattern comprises a plurality of grooves. More preferably, the groove pattern is selected from a groove design, such as one selected from the group consisting of concentric grooves (which may be circular or spiral), curved grooves, cross hatch grooves (e.g., arranged as an X-Y grid across the pad surface), other regular designs (e.g., hexagons, triangles), tire tread type patterns, irregular designs (e.g., fractal patterns), and combinations thereof. More preferably, the groove design is selected from the group consisting of random grooves, concentric grooves, spiral grooves, cross-hatched grooves, X-Y grid grooves, hexagonal grooves, triangular grooves, fractal grooves and combinations thereof. Most preferably, the polishing surface has a spiral groove pattern formed therein. The groove profile is preferably selected from rectangular with straight side walls or the groove cross section may be "V" shaped, "U" shaped, saw-tooth, and combinations thereof.

The methods of making a chemical mechanical polishing pad of the present invention may comprise providing a mold; pouring the reaction mixture of the present invention into the mold; and, allowing the combination to react in the mold to form a cured cake, wherein the polishing layer is derived from the cured cake.

Preferably, the cured cake is skived to derive multiple polishing layers from a single cured cake. Optionally, the method further comprises heating the cured cake to facilitate the skiving operation. Preferably, the cured cake is heated using infrared heating lamps during the skiving operation in which the cured cake is skived into a plurality of polishing layers.

In accordance with the methods of making polishing pads in accordance with the present invention, chemical mechanical polishing pads can be provided with a groove pattern cut into their polishing surface to promote slurry flow and to remove polishing debris from the pad-wafer interface. Such grooves may be cut into the polishing surface of the polishing pad either using a lathe or by a CNC milling machine.

In accordance with the methods of using the polishing pads of the present invention, the polishing surface of the CMP polishing pads can be conditioned. Pad surface "conditioning" or "dressing" is critical to maintaining a consistent polishing surface for stable polishing performance. Over time the polishing surface of the polishing pad wears down, smoothing over the microtexture of the polishing surface—a phenomenon called "glazing". Polishing pad conditioning is typically achieved by abrading the polishing surface mechanically with a conditioning disk. The conditioning disk has a rough conditioning surface typically comprised of imbedded diamond points. The conditioning process cuts microscopic furrows into the pad surface, both abrading and plowing the pad material and renewing the polishing texture.

Conditioning the polishing pad comprises bringing a conditioning disk into contact with the polishing surface either during intermittent breaks in the CMP process when polishing is paused ("ex situ"), or while the CMP process is underway ("in situ"). Typically the conditioning disk is rotated in a position that varies in distance with respect to the axis of rotation of the polishing pad, and sweeps out an annular conditioning region as the polishing pad is rotated.

Preferably, the method of polishing a substrate of the present invention, comprises: providing a substrate selected from at least one of a magnetic substrate, an optical substrate and a semiconductor substrate (preferably a semiconductor substrate, such as a semiconductor wafer); providing a chemical mechanical polishing pad according to the present invention; creating dynamic contact between a polishing surface of the polishing layer and the substrate to polish a surface of the substrate; and, conditioning of the polishing surface with an abrasive conditioner.

EXAMPLES

The present invention will now be described in detail in the following, non-limiting Examples:

Unless otherwise stated all temperatures are room temperature (21-23° C.) and all pressures are atmospheric pressure (~760 mm Hg or 101 kPa).

The following abbreviations appear in the Examples:

PO: Propylene oxide/glycol; EO: Ethylene oxide/glycol; PTMEG: Poly(THF) or polytetramethylene glycol; PPG: poly(propylene glycol); BDO: Butanediol (1,3 or 1,4 regioisomers); DEG: Diethylene glycol; and PP: Polyisocyanate prepolymer; % NU: % Non-uniformity; RR: Removal rate.

Notwithstanding other raw materials disclosed below, the following raw materials were used in the Examples:

PP 1: Low free TDI (<0.5% max) prepolymer from PTMEG and TDI (8.75 to 9.05 wt. % NCO, Mn=760 Da; Mw=870 Da, Chemtura, Philadelphia, Pa.);

PP 2: TDI terminated liquid urethane prepolymer from PTMEG and TDI with from 5 to 15 wt. % of additional $H_{12}$MDI (8.95-9.25 wt. % NCO, Mn=990 Da; Mw=1250 Da, Chemtura);

PP 3: $H_{12}$-MDI terminated liquid urethane prepolymer from PTMEG and $H_{12}$-MDI with additional $H_{12}$-MDI to target 10.35-10.65 wt. % NCO, (PTMEG MW=2000; prepolymer Mn 2500-3000);

PP4: Low free TDI (<0.5% max) prepolymer from a 1/1 mixture of PP1 and Adiprene™ LFG 963A polyisocyanate prepolymer from PPG and TDI (5.55 to 5.85 wt. % NCO, Mn=1600 Da; Mw=2870 Da, Chemtura, Philadelphia, Pa.);

Polyol 1: An aliphatic-amine initiated polyether polyol with number average molecular weight, $M_N$, of ~280 and a hydroxyl functionality of 4 (The Dow Chemical Company, Midland, Mich. (Dow));

Polyol 2: A glycerol initiated polyether polyol with a number average molecular weight, $M_N$, of ~450 and hydroxyl functionality of 3 (Dow);

MbOCA: 4,4'-methylene-bis(2-chloroaniline);

MCDEA: 4,4'-methylenebis(3-chloro-2,6-diethylaniline);

DETDA: Mixture of 3,5-diethytoluene-2,4-diamine and 3,5-diethytoluene-2,6-diamine (ETHACURE™ 100 curative, Albemarle Corporation, Charlotte N.C.);

DMTDA: Dimethyl thiotoluenediamine (ETHACURE™ 300 curative, Albemarle Corporation);

Bead 1: Fluid filled polymeric microspheres with nominal diameter of 40 μm and true density of 42 g/l (Akzo Nobel, Arnhem, NL); and, Bead 2: Fluid filled polymeric microspheres with nominal diameter of 20 μm and true density of 70 g/l (Akzo Nobel);

Pad 1: A CMP polishing pad made with PP1 prepolymer cured with MbOCA at $NH_2$ to NCO stoichiometric ratio of 105%; SG of 0.96 and hardness of 64 Shore D; porosity formed by addition of Bead 2 and a SP2150™ poromeric polyurethane sub-pad (Dow Electronic Materials, Newark, Del.); and Slurry 1: A polishing slurry made with 2 wt. % positively charged colloidal silica particles (25 to 100 nm z-average particle size as measured by Dynamic Light Scattering (DLS) using a Malvern Zetasizer device (Malvern Instruments, Malvern, UK) calibrated per manufacturers recommendations) and a quaternary ammonium compound at pH 4-5.

CMP polishing pads were made from the reaction mixtures indicated in Table 1, below. Each reaction mixture included Bead 2 as a pore former and was formed into a CMP polishing layer using a preblend density of 0.87 g/cm$^3$. Chemical mechanical polishing pads were then constructed from the resulting CMP polishing layers. These CMP polishing layers were then finished to 20" (508 mm) diameter, and machine grooved to provide a 1010 groove pattern (120 mil/3.05 mm pitch, 30 mil/0.76 mm deep, 20 mil/0.51 mm wide). The polishing layers were then laminated to a foam sub-pad layer (SP2150 sub-pad Rohm and Haas Electronic Materials CMP Inc.). The resulting pads were mounted to the polishing platen of the indicated polisher using a double sided pressure sensitive adhesive film.

TABLE 1

CMP Polishing Layer Formulations

| Example | PP | PP % NCO | Aromatic diamine curative | Aromatic diamine curative (wt. %) | Polyol curative | Polyol curative (wt. %) | Stoichiometry (Active H/NCO) |
|---|---|---|---|---|---|---|---|
| 1* | 1 | 8.9 | MbOCA | 100.0 | none | | 1.05:1 |
| 2 | 1 | 8.9 | MbOCA | 81.7 | Polyol 1 | 19.3 | 1.05:1 |
| 3 | 1 | 8.9 | MbOCA | 81.7 | Polyol 1 | 19.3 | 0.87:1 |

*Denotes comparative Example.

Test Methods:

The following methods were used to test the polishing pads.

Polishing Evaluation:

Multiple CMP polishing slurries were evaluated including Slurry 1 (an acidic colloidal silica slurry with 2 wt. % abrasives), CSL9044C™ bulk copper slurry comprising 1.5 wt. % colloidal silica abrasive and 1 wt. % $H_2O_2$, with pH around 7 in use (Fujifilm Planar Solutions, Japan), and W2000™ bulk tungsten slurry comprising 2 wt. % fumed silica abrasive and 2 wt. % $H_2O_2$, with pH of from 2 to 2.5 in use (Cabot Microelectronics, Aurora, Ill.). Each slurry was used to polish the following substrates at two different down-forces:

Slurry 1 (oxide polishing): TEOS and SiN sheet wafers (Novellus Systems, San Jose, Calif.) at 3 psi (20.7 kPa) and 5 psi (34.5 kPa);

CSL9044C (copper polishing): Cu wafers at 1.5 psi (10.3 kPa) and 3 psi (20.7 kPa);

W2000 (tungsten polishing): W, TEOS, and SiN sheet wafers at 2 psi (13.8 kPa) and 4 psi (27.6 kPa).

Prior to polishing, a conditioning disk AMO2BSL8031C1-PM (AK-45™ disk, Saesol Diamond Ind. Co., Ltd, Gyeonggi-do, Korea) was used for CMP polishing pad break-in and conditioning. Each new pad was broken in for 30 min at 7 lbf (31 N) down-force, with 5 minutes additional break-in before a slurry change. In polishing, the conditions used in all of the polishing experiments included a platen speed of 93 rpm; a carrier speed of 87 rpm; with a polishing medium flow rate of 200 mL/min using a Mirra™ CMP polishing platform (Applied Materials, Santa Clara, Calif.). During polishing, 100% in-situ conditioning at 7 lbf (31 N) was used for oxide and copper polishing, and 24 s ex-situ conditioning at 7 lbf (31 N) was used for tungsten polishing. 10 dummy wafers were polished followed by three wafers for which polishing removal rates and other polishing indicia were determined.

The removal rates were determined by measuring the film thickness before and after polishing using a FX200 metrology tool (KLA-Tencor, Milpitas, Calif.) using a 49 point spiral scan with a 3 mm edge exclusion. Polishing results in Removal Rate (RR) are shown in Tables 2, 3 and 4 below. Normalized results set the comparative result at 100% or unity, whichever is applicable.

The % Non-uniformity (% NU): % NU was determined by calculating range of final film thickness after polishing. Polishing results in % NU are shown in Tables 3 and 4, below.

Selectivity:

Selectivity refers to the RR ratio of one substrate material versus another.

TABLE 2

Polishing Results - Oxide

| Pad Example | DF (psi) | TEOS RR (Å/min) | SiN RR (Å/min) | Selectivity (Oxide: SiN) | Normalized TEOS RR |
|---|---|---|---|---|---|
| 1* | 3.0 | 1983 | 115 | 17 | Control |
| 2 | 3.0 | 2359 | 91 | 26 | 119% |
| 3 | 3.0 | 2507 | 70 | 36 | 126% |
| 1* | 5.0 | 2983 | 412 | 7 | Control |

TABLE 2-continued

| Polishing Results - Oxide | | | | | |
|---|---|---|---|---|---|
| Pad Example | DF (psi) | TEOS RR (Å/min) | SiN RR (Å/min) | Selectivity (Oxide: SiN) | Normalized TEOS RR |
| 2 | 5.0 | 3519 | 307 | 11 | 118% |
| 3 | 5.0 | 3774 | 146 | 26 | 127% |

*Denotes comparative Example.

Oxide Polishing Results with Slurry 1:

The CMP polishing pads of the present invention in Examples 2 and 3 delivered a higher TEOS RR than the control pad of Comparative Example 1 at both a 3 psi (20.7 kPa) and 5 psi (34.5 kPa) polishing down-force. Further, the inventive CMP polishing pads enabled a substantial increase in polishing selectivity of oxide versus nitride.

TABLE 3

| Polishing Results - Copper | | | | |
|---|---|---|---|---|
| Pad Example | DF (psi) | Cu RR (Å/min) | % NU | Normalized Cu RR |
| 1* | 1.5 | 2432 | 5.7 | Control |
| 2 | 1.5 | 3068 | 5.9 | 126% |
| 3 | 1.5 | 3060 | 6.0 | 126% |
| 1* | 3.0 | 6555 | 4.6 | Control |
| 2 | 3.0 | 7824 | 6.3 | 119% |
| 3 | 3.0 | 8551 | 3.9 | 130% |

*Denotes comparative Example.

Copper Polishing Results with CSL9044c Slurry:

The CMP polishing pads of the present invention in Examples 2 and 3 delivered a higher Cu RR than the control pad of Comparative Example 1 at both a 1.5 psi (10.3 kPa) and 3 psi (20.7 kPa) polishing down-force.

TABLE 4

| Polishing Results - Tungsten | | | | |
|---|---|---|---|---|
| Pad Example | DF (psi) | W RR (Å/min) | % NU | Normalized Cu RR |
| 1* | 2.0 | 929 | 18.0 | Control |
| 2 | 2.0 | 1298 | 11.7 | 140% |
| 3 | 2.0 | 908 | 12.7 | 98% |
| 1* | 4.0 | 2944 | 11.7 | Control |
| 2 | 4.0 | 3355 | 6.1 | 114% |
| 3 | 4.0 | 2692 | 5.9 | 91% |

*Denotes comparative Example.

Tungsten Polishing Results with W2000 Slurry:

The CMP polishing pads of the present invention in Example 2 and 3 delivered a higher W RR than the control pad of Comparative Example 1 at both a 2 psi (13.8 kPa) and 4 psi (27.6 kPa) polishing down-force. The two inventive CMP polishing pads of Examples 2 and 3 gave dramatically improved % NU in tungsten polishing when compared to the pad of Comparative Example 1, which is critical to wafer yield.

A CMP polishing pad, especially in the asperities of the pad, heats up during polishing when sliding against the substrate being polished. The temperature increase from polishing is a function of polishing conditions including slurry composition, polishing down-force, and relative speed between the polishing pad and the substrate, as well as viscoelastic properties of the CMP polishing layer material. The viscoelastic properties, as indicated by storage modulus (E' or G'), loss modulus (E" or G"), and its ratio or tan-delta (E"/E' or G"/G'), have a strong influence on polishing performance. U.S. Pat. No. 6,860,802B1 to Vishwanathan et al., for example, discloses a CMP polishing pad having an E' (30° C.) to E' (90° C.) of from 1 to 4.6, and that the stored energy contributes to the phenomenon of dishing; however, the CMP polishing layer disclosed in Vishwanathan lacked an amine initiated polyol in a curative and gave polishing results only for copper polishing.

The viscoelastic properties of CMP polishing pads in Comparative Example 1 and Inventive Examples 2 and 3 are shown in Table 6A, below, as tensile storage moduli and tan-delta (E"/E') and in Table 6B, below, as torsional storage moduli and tan-delta (G"/G'). The CMP polishing pads (Ex. 2 and 3) of the present invention have higher tan-delta peak values and much higher modulus ratios (E'(25 C)/E"(80 C), E'(30 C)/E'(90 C), and G'(30 C)/G'(90 C)) than the control pad (Comparative Ex. 1) under both tensile and torsional dynamic deformation.

More CMP polishing pads were made in the manner disclosed, above, in Examples 1, 2 and 3. The reaction mixtures are shown in Table 5, below. Each of the reaction mixtures of Comparative Examples 4, 5, 6 and 7 were formed without microspheres or beads. Each of the reaction mixtures of Comparative Examples 8 and 9 and of inventive Examples 10 to 11 in Table 5 comprised Bead 2 in the polyisocyanate prepolymer component having a preblend density of 0.87 g/cm$^3$. The CMP polishing pads in Examples 14 and 15 were formed without microspheres or beads, and yet, otherwise, were identical to Examples 3 and 12, respectively.

TABLE 5

| More Formulations | | | | | | | |
|---|---|---|---|---|---|---|---|
| Example | PP | PP (% NCO) | Aromatic diamine curative | Aromatic diamine curative (wt. %) | Polyol curative | Polyol curative (wt. %) | Stoichiometry (Active H/NCO) |
| 4* | 2 | 9.15 | MbOCA | 20 | Polyol 2 | 80 | 1.00 |
| 5* | 2 | 9.15 | MbOCA | 33.3 | Polyol 2 | 66.7 | 1.00 |
| 6* | 2 | 9.15 | MbOCA | 50 | Polyol 2 | 50 | 1.00 |
| 7* | 4 | 7.22 | MbOCA | 100 | None | 0 | 1.05 |
| 8* | 3 | 10.5 | MCDEA | 100 | Polyol 1 | 0 | 0.90 |
| 9* | 3 | 10.5 | MCDEA | 100 | Polyol 1 | 0 | 1.00 |
| 10 | 3 | 10.5 | MCDEA | 50 | Polyol 1 | 50 | 0.95 |
| 11 | 3 | 10.5 | MCDEA | 25 | Polyol 1 | 75 | 1.35 |
| 12 | 4 | 7.22 | MbOCA | 81.7 | Polyol 1 | 19.3 | 1.05 |

TABLE 5-continued

More Formulations

| Example | PP | PP (% NCO) | Aromatic diamine curative | Aromatic diamine curative (wt. %) | Polyol curative | Polyol curative (wt. %) | Stoichiometry (Active H/NCO) |
|---|---|---|---|---|---|---|---|
| 13* | 4 | 7.22 | MbOCA | 100 | None | 0 | 1.05 |
| 14 | 1 | 8.9 | MbOCA | 81.7 | Polyol 1 | 19.3 | 0.87 |
| 15 | 4 | 7.22 | MbOCA | 81.7 | Polyol 1 | 19.3 | 1.05 |

*Denotes comparative Example.

As shown in Table 5, above, in accordance with the present invention, a number of CMP polishing pads can be formed from a variety of polyols and curatives, from different polyisocyanate prepolymers, and with or without microspheres or beads.

As shown in Table 6A, below, the CMP polishing pads in accordance with the present invention containing microspheres or beads have a ratio of tensile storage modulus (E') at 30° C. to tensile storage modulus at 90° C. in the range of from 5 to 45.

TABLE 6A

Tensile Storage Moduli at Ambient and High Temperature

| Pad Example | Density (g/cm$^3$) | E'(25 C.)/ E'(80 C.) | E' (25 C.) (MPa) | E' (80 C.) (MPa) | Tan D Peak temp (° C.) | Tan D (value at Peak) | E'(30 C.)/ E'(90 C.) |
|---|---|---|---|---|---|---|---|
| 1* | 0.96 | 3.6 | 535 | 147 | 50 | 0.13 | 3.7 |
| 2 | 0.89 | 15.1 | 450 | 29.7 | 51 | 0.33 | 15.8 |
| 2 | 0.9 | 17.2 | 519 | 30.1 | 53 | 0.33 | 17.8 |
| 3 | 0.93 | 7.8 | 482 | 61.9 | 54 | 0.21 | 7.9 |
| 3 | 0.93 | 6.8 | 415 | 61 | 50 | 0.20 | 6.7 |
| 7* | 1.16 | 3.9 | 407 | 104 | 62 | 0.18 | 4.1 |
| 12 | 0.84 | 18.8 | 302 | 16.1 | 66 | 0.37 | 26.1 |
| 12 | 0.85 | 18.1 | 290 | 16 | 67 | 0.36 | 24.1 |
| 14 | 1.17 | 20.2 | 717 | 35 | 56 | 0.40 | 18.1 |
| 15 | 1.16 | 41.8 | 346 | 8 | 56 | 0.54 | 38.8 |

*Denotes comparative Example.

As shown in Table 6B, below, the CMP polishing pads in accordance with the present invention have a ratio of torsional storage modulus (G') at 30° C. to torsional storage modulus at 90° C. in the range of 5 to 45, tan-delta peak temperature of 50 to 80° C., and tan-delta peak value at the peak temperature of 0.2 to 0.8.

TABLE 6B

Torsional Storage Moduli at Ambient and High Temperature

| Example | Density (g/cm$^3$) | G'@ 30° C. (MPa) | G' @ 90° C. (MPa) | G' (30 C.)/ G' (90 C.) | Tan D Peak temp (° C.) | Tan D (value at Peak) |
|---|---|---|---|---|---|---|
| 1* | 0.96 | 141 | 45.8 | 3.1 | 49 | 0.13 |
| 2 | 0.89 | 139 | 10.8 | 12.8 | 52 | 0.35 |
| 2 | 0.9 | 151 | 11.1 | 13.6 | 53 | 0.36 |
| 3 | 0.93 | 138 | 21.6 | 6.4 | 52 | 0.23 |
| 3 | 0.93 | 146 | 22.6 | 6.5 | 51 | 0.22 |
| 4* | 1.15 | 9 | 3.0 | 3.1 | 26 | 0.78 |
| 5* | 1.15 | 30 | 2.8 | 10.8 | 36 | 0.68 |
| 6* | 1.15 | 82 | 6.1 | 13.5 | 44 | 0.44 |
| 7* | 1.16 | 160 | 42 | 3.8 | 76 | 0.17 |
| 8* | 0.95 | 312 | 170 | 1.8 | 18 | 0.07 |
| 9* | 0.92 | 350 | 193 | 1.8 | 100 | 0.06 |
| 10 | 0.93 | 259 | 20 | 12.8 | 75 | 0.27 |
| 11 | 0.94 | 217 | 5 | 41.1 | 62 | 0.50 |
| 12 | 0.84 | 95 | 5 | 18.9 | 69 | 0.40 |
| 12 | 0.85 | 98 | 5.3 | 18.5 | 69 | 0.40 |
| 13* | 0.84 | 101 | 39.7 | 2.5 | 96 | 0.15 |
| 13* | 0.85 | 115 | 38.2 | 3.0 | 97 | 0.15 |
| 14 | 1.17 | 308 | 16 | 19.1 | 61 | 0.38 |
| 15 | 1.16 | 139 | 81 | 34.2 | 63 | 0.53 |

*Denotes comparative Example.

We claim:

1. A chemical mechanical (CMP) polishing pad for polishing a substrate chosen from at least one of a magnetic substrate, an optical substrate and a semiconductor substrate comprises a polishing layer adapted for polishing the substrate which is a polyurethane reaction product of a reaction mixture comprising (i) a curative of from 15 to 30 wt. % of an amine initiated polyol having an average of from 3 to less than 5 hydroxyl groups and a number average molecular weight of 150 to 400, and from 70 to 85 wt. % of an aromatic diamine and (ii) a polyisocyanate prepolymer having a number average molecular weight of from 600 to 5,000 and having an unreacted isocyanate content ranging from 6.5 to 11%.

2. The CMP polishing pad as claimed in claim 1, comprising as the (i) curative in the reaction mixture from 15 to less than 20 wt. % of an amine initiated polyol having an average of from 3 to less than 5 hydroxyl groups and a number average molecular weight of 150 to 400 and from more than 80 to 85 wt. % of an aromatic diamine.

3. The CMP polishing pad as claimed in claim 1, comprising in the reaction mixture as the (i) curative from 15 to 30 wt. % of an amine initiated polyol having an average of 4 hydroxyl groups.

4. The CMP polishing pad as claimed in claim 1, wherein in the (i) curative of the reaction mixture, the amine initiated polyol is an ethylene diamine or aminoethylethanolamine (AEEA) initiated polyol.

5. The CMP polishing pad as claimed in claim 1, wherein the gel time of the reaction mixture ranges from 2 to 15 minutes and in the (i) curative, the aromatic diamine is chosen from 4,4'-methylenebis(3-chloro-2,6-diethylaniline) (MCDEA); 4,4'-methylene-bis-o-chloroaniline (MbOCA); diethyl toluene diamines; tert-butyl toluene diamines; chlorotoluenediamines; dimethylthio-toluene diamines (DMTDA); 1,2-bis(2-aminophenylthio)ethane; trimethylene glycol di-p-amino-benzoate; tert-amyl toluenediamines; tetramethyleneoxide di-p-aminobenzoate; (poly)propyleneoxide di-p-aminobenzoates; chloro diaminobenzoates; methylene dianilines; isophorone diamine; 1,2-diaminocyclohexane; bis(4-aminocyclohexyl)methane; 4,4'-diaminodiphenyl sulfone; m-phenylenediamine; xylene diamines; 1,3-bis(aminomethyl cyclohexane); and mixtures thereof.

6. The CMP polishing pad as claimed in claim 1, comprising in the reaction mixture (ii) a polyisocyanate prepolymer having a number average molecular weight of from 600 to 5,000 and having an unreacted isocyanate content ranging from 8 to 9.5 wt. %.

7. The CMP polishing pad as claimed in claim 1, wherein in the reaction mixture the (ii) polyisocyanate prepolymer is formed from an aromatic diisocyanate; an aromatic isocyanurate from a diisocyanate; aromatic diisocyanates mixed with up to 50 wt. % of an alicyclic diisocyanate, based on the total weight of the aromatic and any alicyclic diisocyanates; or a mixture of aromatic diisocyanates; and from a polyol chosen from polypropylene glycol (PPG), polytetramethylene ether glycol (PTMEG), polyethylene glycol, or a mixture thereof.

8. The CMP polishing pad as claimed in claim 1, wherein the reaction mixture is "substantially water free", based on the total weight of the reaction mixture.

9. The CMP polishing pad as claimed in claim 1, wherein the polishing pad or polishing layer contains no microelements and the reaction mixture further comprises a surfactant.

10. The CMP polishing pad as claimed in claim 1, wherein the polishing layer has a tan-delta peak temperature at from 50 to 80° C. which has a value of from 0.2 to 0.8 at the tan-delta peak temperature, and which has a ratio of torsional storage modulus (G') measured at 30° C. to torsional storage modulus (G') measured at 90° C. of from 5 to 45.

* * * * *